US008734579B2

(12) United States Patent
Murakami et al.

(10) Patent No.: US 8,734,579 B2
(45) Date of Patent: May 27, 2014

(54) AQUEOUS SOLUTION CONTAINING DIVALENT IRON IONS

(75) Inventors: Masaomi Murakami, Kitaibaraki (JP); Junnosuke Sekiguchi, Kitaibaraki (JP)

(73) Assignee: JX Nippon Mining & Metals Corporation, Chiyoda-ku, Tokyo (JP)

( * ) Notice: Subject to any disclaimer, the term of this patent is extended or adjusted under 35 U.S.C. 154(b) by 267 days.

(21) Appl. No.: 13/382,195

(22) PCT Filed: Oct. 25, 2010

(86) PCT No.: PCT/JP2010/068826

§ 371 (c)(1), (2), (4) Date: Jan. 4, 2012

(87) PCT Pub. No.: WO2011/062030

PCT Pub. Date: May 26, 2011

(65) Prior Publication Data

US 2012/0103229 A1 May 3, 2012

(30) Foreign Application Priority Data

Nov. 18, 2009 (JP) ..... 2009-262714

(51) Int. Cl.
*C23C 18/50* (2006.01)
*C23C 18/52* (2006.01)

(52) U.S. Cl.
USPC ..... 106/1.27

(58) Field of Classification Search
CPC ..... C23C 18/50; C23C 18/52; C25D 3/20
USPC ..... 106/1.27
See application file for complete search history.

(56) References Cited

U.S. PATENT DOCUMENTS

| | | | | |
|---|---|---|---|---|
| 3,893,865 | A * | 7/1975 | Franz et al. | 106/1.27 |
| 4,149,909 | A * | 4/1979 | Hamilton | 148/260 |
| 4,290,860 | A * | 9/1981 | Matsudo et al. | 205/155 |
| 4,540,472 | A * | 9/1985 | Johnson et al. | 205/141 |
| 4,740,278 | A * | 4/1988 | Klos et al. | 205/245 |
| 5,258,078 | A * | 11/1993 | Kinkelaar | 148/259 |
| 6,183,545 | B1 * | 2/2001 | Okuhama et al. | 106/1.27 |
| 8,048,284 | B2 * | 11/2011 | Reddington et al. | 106/1.27 |
| 2012/0118747 | A1 * | 5/2012 | Murakami et al. | 205/50 |

FOREIGN PATENT DOCUMENTS

| | | |
|---|---|---|
| JP | 58-156639 | 9/1983 |
| JP | 62-041718 | 2/1987 |
| JP | 63-024091 | 2/1988 |
| JP | 07-180081 | 7/1995 |
| JP | 07-233494 | 9/1995 |
| JP | 2005-256045 | 9/2005 |

OTHER PUBLICATIONS

Machine translation of JP 2005/256045, Sep. 2005.*
PCT/JP2010/068826 International Search Report (2 pages), Jan. 2011.

* cited by examiner

*Primary Examiner* — Helene Klemanski
(74) *Attorney, Agent, or Firm* — Flynn, Thiel, Boutell & Tanis, P.C.

(57) ABSTRACT

An aqueous solution containing divalent iron ions having improved storage stability such that the oxidation over time of divalent iron ions in the aqueous solution containing divalent iron ions to trivalent iron ions is suppressed and the occurrence of the precipitation of iron (III) hydroxide is prevented for long periods. The aqueous solution contains divalent iron ions having improved storage stability characterized in that it contains divalent iron ions and a hydroxylamine salt as a reducing agent and has a pH of 3.0 or lower. The pH is preferably 2.2 or lower and more preferably 1.2 or lower.

8 Claims, No Drawings

AQUEOUS SOLUTION CONTAINING DIVALENT IRON IONS

TECHNICAL FIELD

The present invention relates to an aqueous solution containing divalent iron ions having improved storage stability.

BACKGROUND ART

When an aqueous solution containing divalent iron ions is left over, divalent iron ions are oxidized to be trivalent iron ions and iron (III) hydroxide is precipitated.

The precipitation of iron (III) hydroxide in an alloy plating solution containing divalent iron ions may be suppressed for example by a method in which a compound capable of forming stable complex ions with trivalent iron ions such as a dicarboxylic acid is added (Patent document 1). By adding a dicarboxylic acid such as malonic acid and adjusting the pH to 1.5, trivalent iron ions are stabilized as complex ions and occurrence of the precipitation is suppressed.

However, although the above complexing agent can suppress occurrence of the precipitation, it cannot suppress oxidation of divalent iron ions to trivalent iron ions. As a result, when it is used in a plating solution, a plating film being stable in composition could not be obtained because the quantities of electricity required for deposition of divalent and trivalent ions are different.

It has been also known that an addition of a reducing agent can suppress production of trivalent iron ions. For example, in Patent document 2, a reducing agent such as L-ascorbic acid and gallic acid is added to an iron group alloy plating solution containing divalent iron ions and the pH is adjusted to 1 to 5, in order to suppress production of trivalent iron ions.

However, production of trivalent iron ions could not be sufficiently suppressed even with the reducing agent such as L-ascorbic acid, as mentioned above.

PRIOR ART DOCUMENTS

Patent Documents

Patent document 1: Japanese Patent Publication No. 7-180081 A

Patent document 2: Japanese Patent Publication No. 7-233494 A

SUMMARY OF INVENTION

Problems that the Invention is to Solve

An object of the present invention is to provide an aqueous solution containing divalent iron ions having improved storage stability such that oxidation over time of divalent iron ions in the aqueous solution containing divalent iron ions to trivalent iron ions is suppressed and occurrence of the precipitation of iron (III) hydroxide is prevented for long periods.

Means for Solving the Problems

The present inventor has carried out extensive studies and found that the above problem can be solved by using a specific reducing agent and adjusting pH to a specific range to accomplish the present invention.

Thus, the present invention provides the followings:

(1) an aqueous solution containing divalent iron ions which consists of divalent iron ions, a hydroxylamine salt as a reducing agent and water and has a pH of 3.0 or lower;

(2) the aqueous solution containing divalent iron ions according to the above (1), wherein the pH is 2.2 or lower;

(3) the aqueous solution containing divalent iron ions according to the above (1) or (2), wherein the pH is 1.2 or lower;

(4) the aqueous solution containing divalent iron ions according to any one of the above (1) to (3), wherein a concentration of the divalent iron ions is 10 to 850 mmol/L and a concentration of the hydroxylamine salt is 1/100 or more as a molar ratio to that of the divalent iron ions;

(5) the aqueous solution containing divalent iron ions according to any one of the above (1) to (4), wherein the aqueous solution further includes a pH adjusting agent to have the pH of 3.0 or lower; and (6) the aqueous solution containing divalent iron ions according to any one of the above (1) to (5), wherein the aqueous solution further includes a complexing agent.

Advantageous Effects of Invention

According to the present invention, oxidation of divalent iron ions in the aqueous solution containing a high concentration of divalent iron ions can be suppressed and occurrence of the precipitation of iron (III) hydroxide can be prevented, so that storage stability thereof is improved. Accordingly, the obtained aqueous solution containing divalent iron ions can be stored stably for long periods.

The aqueous solution containing divalent iron ions of the present invention can be used as an iron source concentrated solution for iron-containing alloy plating such as nickel-iron alloy plating, or an iron ion supplementary solution for an iron-containing alloy plating solution. The use of the concentrated solution may reduce transportation costs. In addition, an aqueous solution containing divalent iron ions at a desired concentration can be obtained merely by diluting the concentrated solution with water, thus the initial make-up of the bath is facilitated compared to the case where powder is dissolved.

MODE FOR CARRYING OUT THE INVENTION

When an aqueous solution containing divalent iron ions is left over, divalent iron ions are oxidized to be trivalent iron ions and iron (III) hydroxide is precipitated. It has been found that addition of a reducing agent is effective for suppressing oxidation of divalent iron ions, which is particularly hydroxylamine salts (inorganic acid salts of hydroxylamine such as hydroxylamine hydrochloride, hydroxylamine sulfate, hydroxylamine nitrate, hydroxylamine phosphate and hydroxylamine carbonate; and organic acid salts of hydroxylamine such as hydroxylamine oxalate and hydroxylamine acetate), with inorganic acid salts of hydroxylamine being more effective among others and addition of hydroxylamine sulfate being particularly effective.

It is also important that the aqueous solution containing divalent iron ions has a pH of 3 or lower, preferably 2.2 or lower and more preferably 1.2 or lower. By reducing the pH, spontaneous decomposition of the hydroxylamine salt is suppressed, so that the suppression effect of oxidation of divalent iron ions is enhanced. By reducing the pH, solubility of the iron ions are also increased, so that the precipitation of hydroxides occurs less, even when divalent iron ions are oxidized to trivalent iron ions. Thus, a lower pH is preferable in terms of storage stability. When the pH exceeds 3, divalent iron ions are immediately oxidized and the precipitation of iron (III) hydroxide occurs, deteriorating the storage stability of the aqueous solution.

The aqueous solution containing divalent iron ions of the present invention can be obtained by dissolving a divalent iron ion source compound and a hydroxylamine salt as a reducing agent in water and adjusting the pH to 3 or lower.

The divalent iron ion source compound may include iron (II) sulfate, iron (II) chloride and the like.

A pH-adjusting agent may include sulfuric acid, hydrochloric acid, sodium hydroxide, potassium hydroxide, tetramethylammonium hydroxide and the like.

The aqueous solution containing divalent iron ions of the present invention may comprise, in addition to the divalent iron ion source compound and the hydroxylamine salt, a complexing agent such as tartaric acid and gluconic acid.

The concentration of divalent iron ions in the aqueous solution of the present invention is preferably 10 to 850 mmol/L. The upper limit of 850 mmol/L corresponds to the saturated solubility in water at 25° C. In view of the applications as the iron source concentrated solution for iron-containing alloy plating such as a nickel-iron alloy plating solution and as an iron ion supplementary solution, the concentration of divalent iron ions in the aqueous solution of the present invention is preferably 10 mmol/L or more.

The amount of the hydroxylamine salt to be added is preferably 1/100 or more as a molar ratio relative to divalent iron ions, in view of the suppression effect of oxidation of divalent iron ions. Basically, the higher the concentration of the hydroxylamine salt is, the higher the suppression effect of oxidation of divalent iron ions is.

The aqueous solution of the present invention can be used as an iron source such as an iron source concentrated solution for an iron-containing alloy plating solution such as a nickel-iron alloy plating solution, and an iron ion supplementary solution. In these cases, when the residual concentration of the reducing agent relative to divalent iron ions is high, the composition of iron is decreased in the resulting plating film. With decomposition of the hydroxylamine salt, the iron content in the plating film is gradually increased, so that variations in the composition of iron in the plating film are increased when the amount of the reducing agent is too high. Thus, when the solution is used as an iron-containing alloy plating solution, the concentration of the hydroxylamine salt is more preferably 1/100 to 1/2 as a molar ratio relative to that of divalent iron ions.

The iron-containing alloy plating solution for which the aqueous solution containing divalent iron ions of the present invention can be used as an iron ion source such as an iron source concentrated solution and an iron ion supplementary solution may include nickel-iron alloy plating solutions, cobalt-iron alloy plating solutions, nickel-cobalt-iron alloy plating solutions and the like.

For instance, when the aqueous solution of the present invention is used as an iron source concentrated solution for a nickel-iron alloy electroplating solution, the aqueous solution of the present invention is diluted with water to adjust the concentrations of iron ions and the hydroxylamine salt as well as the pH, and a nickel salt, an electroconductive salt, a pH buffer, an additive and the like are added to obtain the nickel-iron alloy electroplating solution.

When the aqueous solution of the present invention is used as an iron source concentrated solution for a nickel-iron electroplating solution, the aqueous solution containing divalent iron ions is diluted with water to adjust the concentration of divalent iron ions to 4 to 18 mmol/L, and the pH is further adjusted to 2.5 to 3.0, thereby preparing the nickel-iron alloy electroplating solution; this is preferable because the iron content in the plating film can be 18% by mass or more. The concentration of the hydroxylamine salt is preferably adjusted to 1/100 to 1/2 as a molar ratio relative to that of divalent iron ions, more preferably 1/25 to 1/2. When the concentration of divalent iron ions is lower than 4 mmol/L, the iron content in the plating films obtained during plating can not be 18% by mass or higher, thus soft magnetic films can not be obtained. When it is higher than 18 mmol/L, the required amount of the hydroxylamine salt is increased; thus, when the concentration of the hydroxylamine salt is too high, the iron content in the plating films obtained during plating tends to be decreased. With decomposition of the hydroxylamine salt, the iron content in the plating films is gradually increased; thus in order to maintain the iron content at a constant level, the concentration of the iron ion in the plating solution and stirring speed need to be altered. Accordingly, the conditions for plating need to be changed all the time, rendering plating procedures complicated.

When the aqueous solution of the present invention is used as an iron ion supplementary solution for iron-containing alloy plating, the aqueous solution of the present invention may be diluted with water to adjust the concentrations of iron ions and the hydroxylamine salt as well as the pH.

By using the aqueous solution of the present invention as an iron ion source such as an iron source concentrated solution for iron-containing alloy electroplating or an iron ion supplementary solution, transportation costs are decreased. In addition, an aqueous solution containing divalent iron ions at a desired concentration can be obtained by merely diluting the aqueous solution of the present invention with water, thereby the initial make-up of the bath is facilitated compared to the case where a powder is dissolved.

EXAMPLES

The present invention is now illustrated by means of examples.

Examples 1 to 5

An aqueous solution of iron (II) sulfate heptahydrate was added with hydroxylamine sulfate with compositions described in Table 1, the pH was adjusted with sulfuric acid and then the solution was left at room temperature (20 to 25° C.). The number of days required for the occurrence of the precipitation of iron (III) hydroxide was determined. The results are summarized in Table 1.

TABLE 1

| | Concentration of iron (II) sulfate (mmol/L) | Reducing agent | Concentration of reducing agent (mmol/L) | pH | Number of days required for occurrence of precipitation at room temperature (days) |
|---|---|---|---|---|---|
| Example 1 | 360 | Hydroxylamine sulfate | 18 | 2.0 | >1 year |
| Example 2 | 360 | Hydroxylamine sulfate | 36 | 1.0 | >1 year |
| Example 3 | 360 | Hydroxylamine sulfate | 36 | 2.0 | >1 year |
| Example 4 | 110 | Hydroxylamine sulfate | 11 | 2.7 | >1 year |
| Example 5 | 13 | Hydroxylamine sulfate | 1.3 | 2.7 | >1 year |

Examples 6 to 8 and Comparative Examples 1 to 5

A 360 mmol/L (100 g/L) iron (II) sulfate heptahydrate aqueous solution was added with various reducing agents as shown in Table 2 at 36 mmol/L, the pH was adjusted with sulfuric acid and then the solution was left at room temperature (20 to 25° C.). The number of days required for the occurrence of the precipitation of iron (III) hydroxide was determined. The results are summarized in Table 2.

TABLE 2

| | Concentration of iron (II) sulfate (mmol/L) | Reducing agent | Concentration of reducing agent (mmol/L) | pH | Number of days required for occurrence of precipitation at room temperature (days) |
|---|---|---|---|---|---|
| Example 6 | 360 | Hydroxylamine sulfate | 36 | 2.7 | 186 |
| Example 7 | 360 | Hydroxylamine hydrochloride | 36 | 2.7 | 105 |
| Example 8 | 360 | Hydroxylamine nitrate | 36 | 2.7 | 90 |
| Comparative Example 1 | 360 | L (+)-ascorbic acid | 36 | 2.7 | 29 |
| Comparative Example 2 | 360 | Hypophosphorous acid | 36 | 2.7 | 18 |
| Comparative Example 3 | 360 | D (+)-glucose | 36 | 2.7 | 3 |
| Comparative Example 4 | 360 | None | — | 2.7 | 0 |
| Comparative Example 5 | 360 | Hydroxylamine hydrochloride | 36 | 4.0 | 0 |

When a hydroxylamine salt was used as a reducing agent and the pH was adjusted to 2.7 (Examples 6 to 8), no precipitation occurred for periods as long as 90 days or more. Other than these, the precipitation occurred within 30 days. In case when the pH was 4.0, the precipitation immediately occurred even when hydroxylamine was added (Comparative Example 5).

Examples 9 and 10 and Comparative Example 6

A 360 mmol/L (100 g/L) iron (II) sulfate heptahydrate aqueous solution was added with hydroxylamine sulfate at 18 mmol/L, the pH was adjusted to 2.0 with sulfuric acid and then the solution was maintained at 60° C. (Example 9). A 13 mmol/L (3.5 g/L) iron (II) sulfate heptahydrate aqueous solution was added with (Example 10) or without (Comparative Example 6) hydroxylamine sulfate at 1.3 mmol/L, the pH was adjusted to 2.7 with sulfuric acid and then the solution was maintained at 60° C. The number of days required for the occurrence of the precipitation of iron (III) hydroxide was determined. The results are summarized in Table 3.

TABLE 3

| | Concentration of iron (II) sulfate (mmol/L) | Reducing agent | Concentration of reducing agent (mmol/L) | pH | Number of days required for occurrence of precipitation at 60° C. (days) |
|---|---|---|---|---|---|
| Example 9 | 360 | Hydroxylamine sulfate | 18 | 2.0 | 42 |
| Example 10 | 13 | Hydroxylamine sulfate | 1.3 | 2.7 | 20 |
| Comparative Example 6 | 13 | None | — | 2.7 | 1 |

When hydroxylamine sulfate was not added, the precipitation occurred after one day, while when hydroxylamine sulfate was added, the precipitation was not produced until day 20. When the pH was reduced to 2.0, the number of days required for the occurrence of precipitation was extended to 42 days, even when the concentration of iron sulfate was relatively high.

Comparative Examples 7 to 9

A 360 mmol/L (100 g/L) iron (II) sulfate heptahydrate aqueous solution was added with various complexing agents as shown in the following Table 4 at 36 mmol/L, the pH was adjusted to 2.7 with sulfuric acid and then the solution was maintained at room temperature (20 to 25° C.). The number of days required for the occurrence of the precipitation of iron (III) hydroxide was determined. The results are summarized in Table 4.

TABLE 4

| | Concentration of iron (II) sulfate (mmol/L) | Complexing agent | Concentration of complexing agent (mmol/L) | pH | Number of days required for occurrence of precipitation at room temperature (days) |
|---|---|---|---|---|---|
| Comparative Example 7 | 360 | Malonic acid | 36 | 2.7 | 45 |
| Comparative Example 8 | 360 | Succinic acid | 36 | 2.7 | 1 |
| Comparative Example 9 | 360 | Adipic acid | 36 | 2.7 | 8 |

Examples 11 and 12

A 110 mmol/L (30 g/L) iron (II) sulfate heptahydrate aqueous solution was added with hydroxylamine sulfate at 11 mmol/L, the pH was adjusted to 2.0 (Example 11) or 1.0 (Example 12) with sulfuric acid and then the solution was left at room temperature (20 to 25° C.). No precipitation occurred in either solution after 180 days. The ratio of divalent iron ions relative to total iron ions in the solutions and the residual ratio of the reducing agent relative to the initial concentration of the reducing agent were determined. The results are summarized in Table 5.

The ratio of divalent iron ions in the solution after 180 days at room temperature was calculated from the following respective values. The concentration of divalent iron ions in the aqueous solution was measured by absorbance measurements utilizing the fact that 1,10-phenanthroline forms a complex with $Fe^{2+}$ to develop a red color. The total iron ion concentration was measured by converting all the iron ions in the solution to divalent ions by adding a hydroxylamine salt in excess and measuring the concentration thereof in a similar manner as above.

The concentration of the reducing agent was measured by adding to the aqueous solution a Tris-hydrochloride buffer, an ethanol solution of 8-quinolinol and an aqueous solution of sodium carbonate, mixing them thoroughly, and measuring the absorbance at 707 nm. The residual ratio of the reducing agent after 180 days at room temperature relative to the initial concentration of the reducing agent was obtained by measuring the reducing agent concentrations immediately after and 180 days after preparation of the aqueous solution containing divalent iron ions in a manner described above and dividing the concentration of the reducing agent after 180 days by the concentration of the reducing agent immediately after preparation.

TABLE 5

| | Concentration of iron (II) sulfate (mmol/L) | Reducing agent | Concentration of reducing agent (mmol/L) | pH | Fe2+/Fe total after 180 days at room temperature | Residual ratio of reducing agent after 180 days at room temperature |
|---|---|---|---|---|---|---|
| Example 11 | 110 | Hydroxylamine sulfate | 11 | 2.0 | 90% | 20% |
| Example 12 | 110 | Hydroxylamine sulfate | 11 | 1.0 | 82% | 80% |

The divalent iron ion ratio after 180 days were as high as 80% or more in either solution, while the solution of pH 2.0 had a higher value. On the other hand, the residual ratio of the reducing agent after 180 days was as high as 80% for the solution of pH 1.0, while it was as low as 20% for the solution of pH 2.0.

These solutions were diluted with water to the concentration of divalent iron ions of 11 mmol/L, so that a nickel-iron alloy electroplating solution was obtained (plating solution compositions: 168 mmol/L nickel (II) chloride; 76 mmol/L nickel (II) sulfate; 11 mmol/L iron (II) sulfate; 404 mmol/L boric acid; 187 mmol/L ammonium chloride; 5.5 mmol/L saccharin; pH 2.7 (sulfuric acid)), which was used for electroplating at a bath temperature of 25° C., a cathode current density of 1.5 A/dm$^2$ and plating time of 20 minutes, with an electrolytic nickel sheet being used as an anode. The concentration of hydroxylamine sulfate in the plating solution was the same as the concentration in the iron (II) sulfate storage solution after 180 days, i.e. no hydroxylamine sulfate was added. Because the solution of pH 2.0 had a low reducing agent concentration, oxidation of iron ions was facilitated during plating, so that the precipitation occurred after a few times of plating. On the other hand, because the solution of pH 1.0 had a high reducing agent concentration, oxidation of iron ions was suppressed also during plating, thus no precipitation occurred after more than a dozen times of plating. Therefore, when the solution is used as a starting material for nickel-iron alloy electroplating without the addition of a reducing agent, a lower pH of the solution allows the preparation of a more stable plating solution. When the solution is stored at a high pH of around 2.0 and the concentration of a reducing agent is decreased, the reducing agent may be added at the time of preparation of a plating solution; by adjusting the concentration of the reducing solution, a more stable solution can be prepared.

The invention claimed is:

1. An aqueous solution containing divalent iron ions, having a pH of 3.0 or lower and consisting of a divalent iron ion source compound, a hydroxylamine salt as a reducing agent, a pH adjusting agent and water.

2. The aqueous solution containing divalent iron ions according to claim 1, wherein the pH is 2.2 or lower.

3. The aqueous solution containing divalent iron ions according to claim 1, wherein the pH is 1.2 or lower.

4. The aqueous solution containing divalent iron ions according to claim 1, wherein a concentration of the divalent iron ions is 10 to 850 mmol/L and a concentration of the hydroxylamine salt is 1/100 or more as a molar ratio to that of the divalent iron ions.

5. An aqueous solution containing divalent iron ions, having a pH of 3.0 or lower and consisting of a divalent iron ion source compound, a hydroxylamine salt as a reducing agent, a pH adjusting agent, a complexing agent and water.

6. The aqueous solution containing divalent iron ions according to claim 5, wherein the pH is 2.2 or lower.

7. The aqueous solution containing divalent iron ions according to claim 5, wherein the pH is 1.2 or lower.

8. The aqueous solution containing divalent iron ions according to claim 5, wherein a concentration of the divalent iron ions is 10 to 850 mmol/L and a concentration of the hydroxylamine salt is 1/100 or more as a molar ratio to that of the divalent iron ions.

* * * * *